US005713113A

United States Patent [19]

Demir

[11] Patent Number: 5,713,113

[45] Date of Patent: Feb. 3, 1998

[54] DEVICE FOR TREATING AT LEAST ONE RUNNING MULTIFILAMENT YARN

[75] Inventor: Ali Demir, Istanbul, Turkey

[73] Assignee: Heberlein Maschinenfabrik AG, Wattwil, Switzerland

[21] Appl. No.: 680,981

[22] Filed: Jul. 16, 1996

Related U.S. Application Data

[63] Continuation of Ser. No. 240,181, May 9, 1994, abandoned.

[30] Foreign Application Priority Data

May 11, 1993 [CH] Switzerland ..... 1436/93

[51] Int. Cl.[6] ..... D02G 1/16

[52] U.S. Cl. ..... 28/274; 28/272

[58] Field of Search ..... 28/271, 272, 273, 28/274, 275, 276

[56] References Cited

U.S. PATENT DOCUMENTS

| | | | |
|---|---|---|---|
| 2,958,112 | 8/1960 | Hall . | |
| 3,638,291 | 2/1972 | Yngve . | |
| 3,828,404 | 8/1974 | Peckinpaugh et al. . | |
| 3,916,493 | 11/1975 | Ethridge | 28/276 |
| 3,983,609 | 10/1976 | Pike . | |
| 4,070,815 | 1/1978 | Negishi et al. | 28/276 |
| 4,251,904 | 2/1981 | Sano et al. | 28/276 |
| 4,507,833 | 4/1985 | Simmen . | |
| 4,633,550 | 1/1987 | McAliley | 28/276 |
| 4,641,504 | 2/1987 | Runkel et al. | 28/272 |
| 4,691,947 | 9/1987 | Burkhardt et al. | 28/272 |
| 5,157,819 | 10/1992 | Hodan | 28/276 |

FOREIGN PATENT DOCUMENTS

| | | | |
|---|---|---|---|
| 0 140 526 | 5/1985 | European Pat. Off. . | |
| 0189099 | 1/1986 | European Pat. Off. | 28/273 |
| 2856291 | 3/1980 | Germany . | |
| 4716270 | 5/1972 | Japan | 24/274 |
| 4751664 | 12/1972 | Japan | 28/273 |
| 1178753 | 4/1968 | United Kingdom . | |
| 1282148 | 7/1972 | United Kingdom . | |
| 2 079 189 | 1/1982 | United Kingdom . | |
| 2 178 072 | 2/1987 | United Kingdom . | |
| 924089 | 4/1993 | United Kingdom . | |

OTHER PUBLICATIONS

Lünenscholss, J., *Intermingling of Synthetic Filament Yarns in an Air Flow*, The Institute for Textile Technology of the RWTH Aachen, Texile Praxis International, No. 9, 1982, pp. 934–936 & VII–IX.

Weinsdörfer, *Production and testing of tanglelaced yarns*, Chemiefasern/Textillindustrie, vol. 36/88, May 1986, pp. 289–295 & E41–E44.

Bock, et al., *Dusenstromung und Schlingenbildung biem aerodynamishen Texturieren* (Air–jet Stream and Loop Formation in Aerodynamic Texturing); Chemiefasern/Textillindustrie, vol. 31/83, Mar. 1981 and May 1981, pp. 202–204 & 380–384 and E41.

Demir, Ali, "The Air–Jet Yarn Texturing Process With Particular Reference to Nozzle Design and Improved Yarn Test Methods," Oct. 1987, Table of Contents, Chaps. 1, 5, and 6, and Figs. 4.1a–14b.

*Primary Examiner*—C. D. Crowder
*Assistant Examiner*—Larry D. Worrell, Jr.
*Attorney, Agent, or Firm*—Finnegan, Henderson, Farabow, Garrett & Dunner

[57] ABSTRACT

A device for treating at least one running multifilament yarn with compressed air contains one continuous yarn channel (13, 14, 15) which is circular in cross section. Into a cylindrical middle section (14) of the yarn channel (13, 14, 15) three blowing medium feed holes (16, 17) empty. The axes of these blowing medium feed holes (16, 17)intersect the axis of the yarn channel (13, 14, 15) at one common point each at an angle of 15° to 40°. With this device it is possible to treat multifilament yarn (M1) which is supplied to the yarn channel (13, 14, 15) with an excess delivery of 0 to 15% and which is discharged, transversely to the axis of the yarn channel (13, 14, 15), from the device such that the filaments of yarn are uniformly intertwined with one another over the length of the yarn and thus no protruding loops are formed.

15 Claims, 2 Drawing Sheets

DEVICE FOR TREATING AT LEAST ONE RUNNING MULTIFILAMENT YARN

This is a continuation of application Ser. No. 08/240,181 filed May 9, 1994, now abandoned.

BACKGROUND OF THE INVENTION

The invention relates to a device for treating at least one running multifilament yarn with a blowing medium, with a continuous yarn channel which is circular in cross section and which has a cylindrical center section into which a number of blowing medium feed holes discharge laterally.

These devices, in which a blowing medium, generally compressed air, essentially at the ambient temperature, is blown through the feed holes onto a multifilament yarn which runs through the yarn channel, are known in many versions. The blowing medium serves to change the mutual spatial arrangement of the filaments in the multifilament yarn in order to modify the appearance and hand of the yarn and/or improve the cohesion of the filaments in the yarns for further processing.

The known devices are, for example, texturing devices to which a multifilament yarn or several multifilament yarns are supplied with a speed which is higher than the discharge speed of the yarn from the device. The speed difference, generally called excess delivery, can be roughly 10 to 30%. The supplied yarns are generally smooth yarns onto which the blowing medium impinges in the yarn channel from one or several blowing medium feed holes sloped to the axis of the yarn channel. The treated, textured yarn has a compact core in which the filaments are closely intertwined with one another and from which filament loops stick out. The yarn is not elastic. The filament loops which stick out from the surface are also disadvantageous for many applications, since they can easily catch.

Other known devices are called vortexing devices. In them a multifilament yarn or several multifilament yarns with only little excess delivery, at most roughly 10%, is routed through the yarn channel in which it is exposed to blowing medium from a blowing medium feed hole with an axis which is roughly perpendicular to the axis of the yarn channel. This treatment causes vortexing nodes in the yarn at more or less regular distances from one another in which the yarn filaments are intertwined with one another. In this way the filaments acquire the necessary cohesion for further processing of the yarn. Almost no filament loops are formed. The supplied multifilament yarns can be smooth or also, for example, false twist textured. If it is elastic, the yarn is still elastic after treatment in the vortexing device. However, the nonuniform yarn structure with the discrete vortexing nodes, which are separated from one another by unvortexed sites can be disruptive for certain applications. The vortexing nodes separated from one another do not completely disappear during further processing (for example, during weaving or knitting and if necessary finishing) and can produce undesirable moire effects in the final product.

The problem of the invention was to design the device indicated at the beginning such that multifilament yarns can be treated in it such that the filaments of the supplied multifilament yarn or yarns are intertwined with one another over the length of the yarn in a uniform manner, without the formation of vortexing nodes which are separate from one another and thus form almost no protruding filament loops.

SUMMARY OF THE INVENTION

The device according to the invention with which the problem is solved is characterized in that the number of blowing medium feed holes is three and that these holes are arranged at uniform angular distances from one another such that their axes intersect the axis of the yarn channel at one common point each at an angle of 15° to 40°.

Preferably the yarn channel in front of the cylindrical middle section has a conically constricting inlet section and following the cylindrical middle section a flaring outer section.

With this device a yarn can be obtained with the aforementioned desired properties when a multifilament yarn or multifilament yarns with an excess delivery in the range from 0 to at most 15% is supplied to the device and the treated yarn is discharged from the outlet of the device transversely to the axis of the yarn channel, preferably at an angle of roughly 90° to the yarn channel axis.

BRIEF DESCRIPTION OF THE DRAWINGS

One embodiment of the invention is detailed below with reference to the drawings, wherein.

DESCRIPTION OF THE PREFERRED EMBODIMENT

Figure 1:
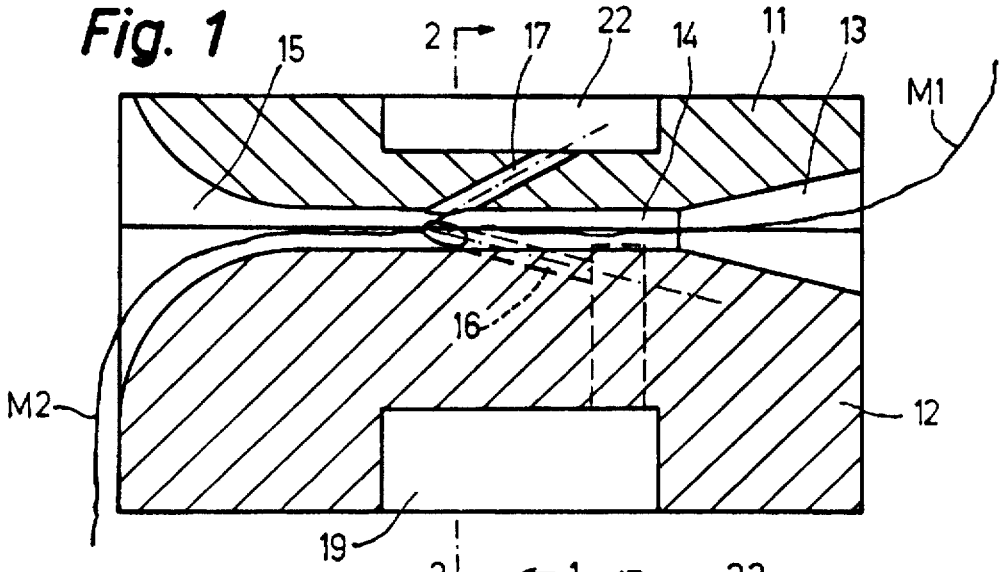
FIG. 1 shows a two-part body of a device for treating multifilament yarn in a schematic longitudinal section on line 1—1 in FIG. 2.
Figure 2:
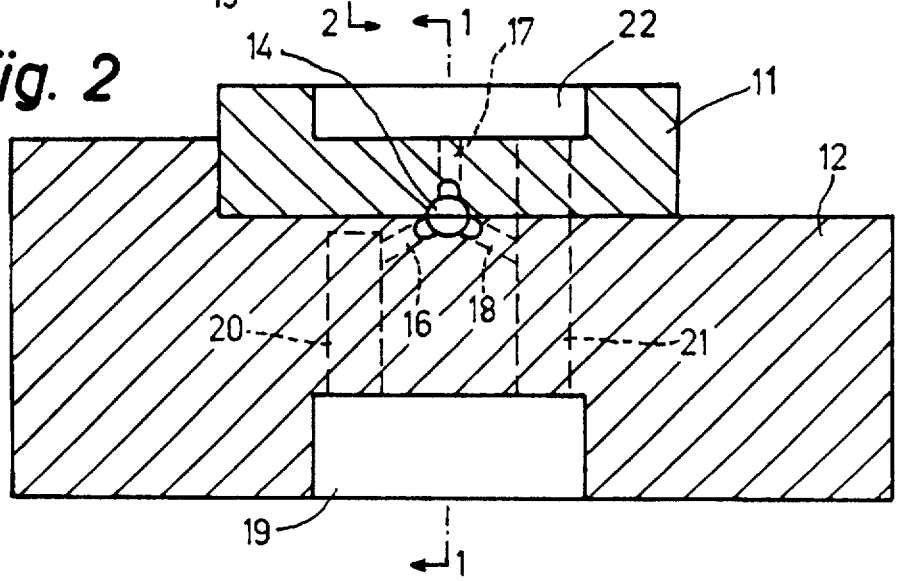
FIG. 2 shows a schematic cross section on line 2—2 in FIG. 1.
Figure 3:
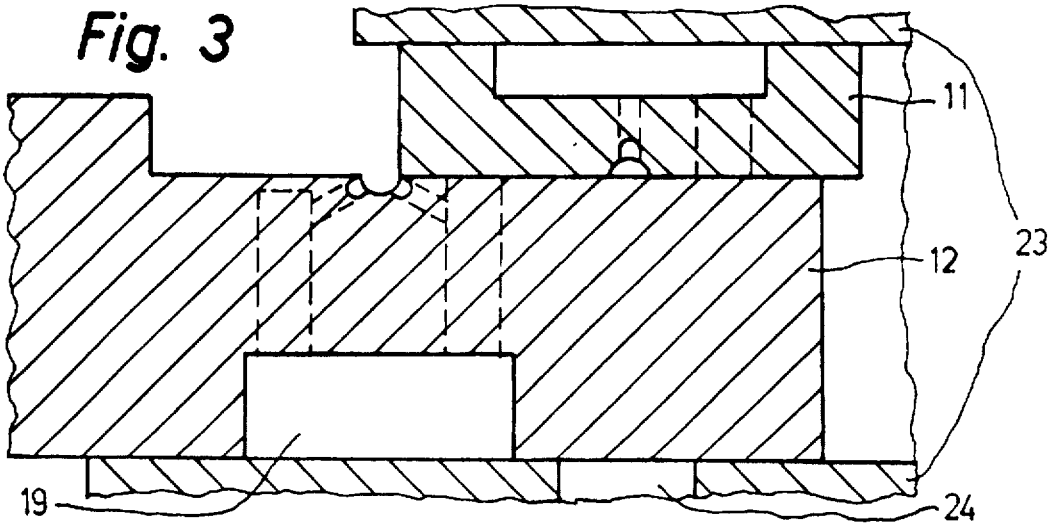
FIG. 3 shows the same cross section as in FIG. 2 in a different position of the parts.

The body shown in FIGS. 1 through 3 consists of two parts 11 and 12 on top of one another. In the sides of the two parts 11 and 12 facing one another there are depressions which in the operating position of the two parts according to FIGS. 1 and 2 together bound a continuous yarn channel which is circular in cross section and which consists of a progressively constricting inlet section 13, a cylindrical middle section 14 and flaring outlet section 15. Cylindrical middle section 14 of the yarn channel has a diameter of 1 to 2 mm, preferably roughly 1.2 mm.

Three blowing medium feed holes 16, 17, and 18 which are distributed around the axis of the yarn channel at the same angular distances from one another discharge laterally in cylindrical middle section 14 of the yarn channel. The axes of holes 16, 17 and 18 intersect the axis of yarn channel 13, 14, 15 at a common point each at an angle in the range from 15° to 40°, preferably 25° to 35°, and best, roughly 30°. The three holes 16, 17, and 18 all have the same diameter or slightly different diameter in the range from 0.4 to 0.8 mm. Preferably all three holes have an identical diameter in the range from 0.55 to 0.65 mm, best roughly 0.6 mm.

Multifilament yarn M1 or several multifilament yarns (not shown) is supplied to yarn channel 13, 14, 15. The supplied multifilament yarns can be smooth and/or textured yarns made, for example, of polyamide and/or polyester.

A blowing medium, generally compressed air at ambient temperature, is supplied to blowing medium feed holes 16, 17 and 18 from inlet 19 via delivery hole 20 which leads to hole 16, and delivery hole 21 which leads to hole 18 and to chamber 22 from which hole 17 proceeds.

Due to the described geometry with three blowing medium feed holes 16, 17 and 18 which form a small angle of less than 40° with the axis of yarn channel 13, 14, 15 it is possible to treat the supplied multifilament yarn M1 or the supplied multifilament yarns such that after treatment compact multifilament yarn M2 is obtained in which the individual filaments are simultaneously closely intertwined with one another over the length of the yarn which however has no protruding filament loops. The prerequisite for attaining this result is simply that multifilament yarn M1 or the multifilament yarns to be treated is supplied to yarn channel 13, 14 and 15 each with excess delivery in the range from 0 to at most 15%, preferably at most 10%, and that the treated yarn is discharged from the outlet of the yarn channel as shown in one direction transversely to the axis of the yarn channel. If several multifilament yarns are supplied at the same time, the excess delivery, i.e., the percentage by which the feed rate is higher than the discharge rate of the treated yarn, can be the same for all delivered yarns or can be different also for different delivered yarns, always in the indicated range up to at most 15%.

The body of the described preferred embodiment of the device according to the invention consists as indicated of two parts 11 and 12. They are arranged in mounting 23 shown schematically in FIG. 3 such that one part 12 can be shifted with reference to the other part 11 between the operating position according to FIGS. 1 and 2 and a threading position according to FIG. 3. In the operating position the depressions in the sides of two parts 11 and 12 which face one another bound as indicated yarn channel 13, 14 and 15. Conversely, in the threading position shown in FIG. 3 at least one of the two depressions, in the special case the depression in part 12, is exposed for insertion of the multifilament yarn.

Mounting 23 contains blowing medium feed channel 24. In the operating position of part 12 according to FIGS. 1 and 2, blowing medium inlet opening 19 provided in this part 12 is aligned with the mouth of blowing medium feed channel 24 so that the blowing medium from this channel 24 enters feed holes 16, 17 and 18 and is expelled through them into yarn channel 13, 14, 15. If part 12 is shifted by a mechanism which is not shown from the operating position into the threading position according to FIG. 3, part 12 closes the mouth of blowing medium feed channel 24 and the feed of blowing medium into inlet 19 is interrupted.

Treatment example

Figure 4:
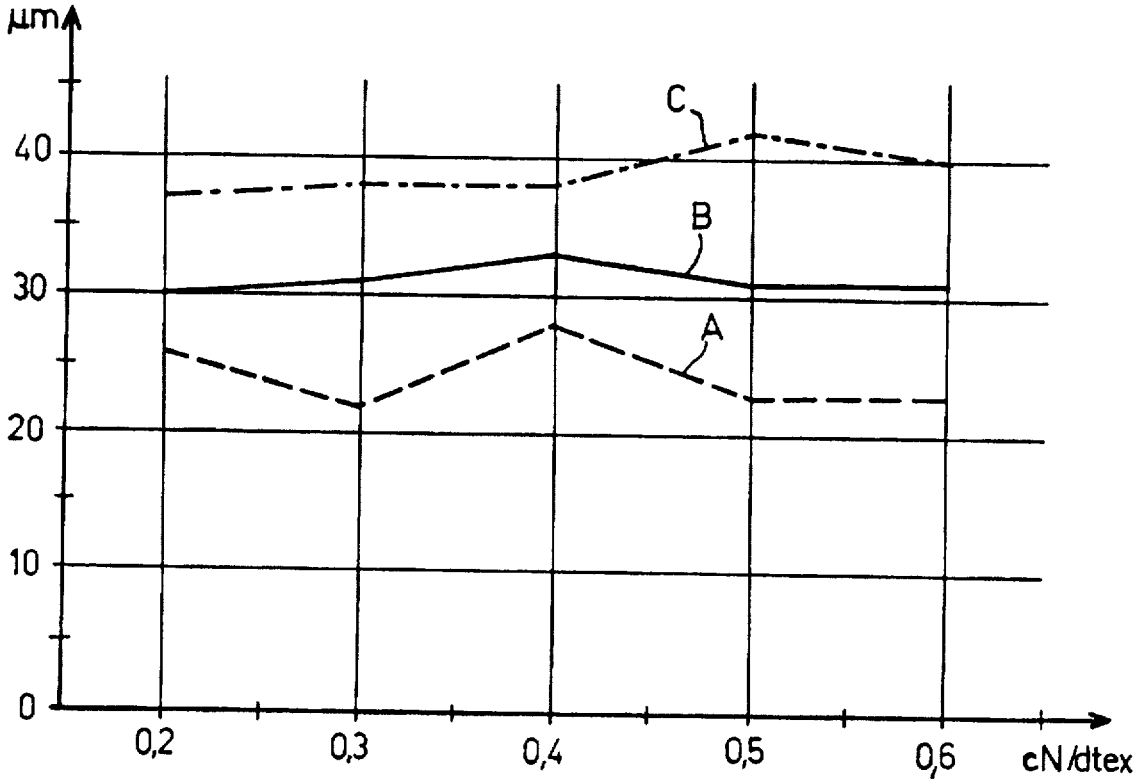
FIG. 4 shows a graphic representation of thickness as a function of the strain for a multifilament yarn untreated, twisted or treated in the device according to the invention.

A partially oriented polyester multifilament yarn with titer 90f40 underwent conventional stretch texturing at 500 m/min. The product of stretch texturing was a highly elastic polyester yarn with titer 50f40. The thickness of this yarn as a function of yarn stress is shown in FIG. 4 by curve A. Following the delivery roller of the stretch texturing machine a treatment device was arranged as described above using FIGS. 1 through 3. At this point the stretch texturing process has been completed. The highly elastic textured yarn was inserted with excess delivery of 5% into the yarn channel of the treatment device, without wetting. Compressed air with a pressure of 3 bar was supplied to the treatment device and the treated yarn was discharged at an angle of 90° to the axis of yarn channel 13, 14, 15 from the treatment device. The filaments of the yarn obtained were intertwined with one another continuously over the length of the yarn and no protruding loops were formed. The thickness of this yarn as a function of yarn stress is shown in FIG. 4 by curve B.

For comparison, the highly elastic yarn obtained as the product of stretch texturing was genuinely twisted at 200 rpm. The thickness of the twisted yarn as a function of stress is shown in FIG. 4 by curve C.

FIG. 4 shows that the yarn treated in the device according to the invention (curve B) in comparison to the supplied stretch textured yarn (curve A) exhibits an improvement with respect to thickness, however it not yet as thick as the twisted yarn (curve C). Visual examination of the three yarns yields similar results: The yarn treated as described, by use of the device according to the invention, is more compact than the supplied stretch textured yarn, but less compact than the twisted yarn.

The capacity of the yarn treated in the device according to the invention to be further processed compared to the supplied stretch textured yarn is greatly improved; this is shown, for example, when unwinding at high speed and during weft insertion during weaving. The filaments in the yarn are intertwined with one another such that fabrics with very uniform structure and uniform dye affinity can be produced with the yarns.

What is claimed is:

1. A device for treating at least one multifilament yarn to create uniform, knotless yarn comprising:

a body having a conical inlet for receiving the untreated yarn, the inlet having a narrow diameter portion;

a central channel having a cylindrical central portion, the channel having a central axis and being connected at one axial end to the inlet narrow diameter portion;

a plurality of air holes connectable to a source of compressed air and located at uniform angular distances around and communicating with the channel each one of the plurality of air holes having an axis forming an angle of about 15° to 40° to the central axis; and a flaring outlet connected to the other axial end of the channel for removal of the treated yarn at an angle relative to the central axis, wherein the body has first and second sections in contact along a planar interface passing longitudinally through the central axis, the device further including a mounting for holding the first and second sections, and wherein the first and second sections are slidable relative to each other along the plane of the interface for threading and operating.

2. The device according to claim 1 wherein the cylindrical central portion has a diameter of about 1 to 2 mm.

3. The device according to claim 1 wherein the cylindrical central portion has a diameter of about 1.2 mm.

4. The device according to claim 1 wherein each one of the plurality of air holes has an axis forming an angle of about 25° to 35° to the central axis.

5. The device according to claim 1 wherein each one of the plurality of air holes has an axis forming an angle of about 30° to the central axis.

6. The device according to claim 1 wherein each one of the plurality of air holes has a diameter of about 0.4 to 0.8 mm.

7. The device according to claim 1 wherein each one of the plurality of air holes has a diameter of about 0.55 to 0.65 mm.

8. The device according to claim 1 wherein each one of the plurality of air holes has a diameter of about 0.6 mm.

9. The device according to claim 1 wherein the plurality of air holes consists of three air holes.

10. A device for treating at least one multifilament yarn with compressed air comprising:

a body having first and second sections in contact along a planer interface, the first and second sections being slidable relative to each other for threading and operating;

a mounting for holding the body, the body being in the mounting;

a depression in each of the first and second body sections, the depressions forming a central channel, the central channel having a cylindrical central portion, an increasingly constrictive inlet, a flaring outlet and a central axis when the first and second body sections are aligned for operation, said planer interface passing longitudinally through the central axis;

three air holes located at uniform angular distances around the central channel and having an axis at an angle of 15° to 40° to the central axis; and a blowing medium channel located in the mounting and in communication with the three air holes through an inlet opening when the first and second sections are in an operating position.

11. A device for treating at least one multifilament yarn with a blowing medium comprising:

a body comprising first and second sections in contact along a planar interface;

a mounting for holding the body sections for relative slidable movement;

a continuous yarn channel formed in said body with a central axis along the planar interface and having a middle section, an inlet and an outlet section for creating uniform, knotless intertwined yarn with an excess delivery of the multifilament yarn in the range of 0 to at most 15% to the device and discharging the treated yarn from the outlet of the device transversely to the central axis of the yarn channel, whereby the continuous yarn channel is circular in cross section and has a cylindrical middle section into which compressed air holes discharge laterally, the air holes are connectable to a source of compressed air and located at uniform angular distances around and communicating with the cylindrical section, each air hole having an axis forming an angle of about 15° to 40° to the central axis, and the outlet section follows the cylindrical middle section and is of a flaring outer section for removal of the treated yarn with almost no protruding filament loops.

12. A method for treating at least one multifilament yarn to intertwine the multifilaments without the formation of a substantial number of protruding loops, the method comprising:

feeding the least one multifilament yarn with less than 15% excess delivery into a body having a conical inlet;

passing the yarn through a central channel in the body, the channel having a continuous cylindrical central portion and a central axis;

introducing compressed air into the central channel at an angle of about 15° to 40° to the central axis through a plurality of air holes located at uniform angular distances around the central channel; and removing the treated yarn at an angle of about 90° relative to the central axis through a flaring outlet in the body, the yarn being knot-free and having substantially no protruding yarn filament loops.

13. The method of claim 12 wherein the yarn is fed into the inlet with an excess deliver of 5%.

14. A device for intertwining at least one multifilament yarn to create uniform, knotless yarn comprising:

a body having first and second sections in contact along a planar interface;

a conical inlet for receiving the untreated yarn, the inlet having a narrow diameter portion;

a central channel having a cylindrical central portion, the channel having a central axis and being connected at one axial end to the inlet narrow diameter portion;

a plurality of air holes connectable to a source of compressed air and located at uniform angular distances around and communicating with the channel to intertwine the at least one multifilament yarn, each one of the plurality of air holes having an axis forming an angle of about 15° to 40° to the central axis; and a flaring outlet connected to the other axial end of the channel for removal of the intertwined yarn at an angle relative to the central axis, said intertwined yarn being substantially free of protruding loops.

15. A method for intertwining at least one multifilament yarn using a body having a central channel with a conical inlet, a flaring outlet, and an axis, the body also having first and second sections in contact along a planar interface passing longitudinally through the axis, the body sections being slidable relative to one another along the interface, the method comprising:

sliding one of said first and second sections relative to the other to a threading position to expose the central channel;

threading the yarn to be treated through the exposed central channel;

sliding said one section to an operating position to capture said threaded yarn;

feeding the least one multifilament yarn with less than 15% excess delivery through the conical inlet and;

passing the yarn through the central channel in the body while introducing compressed air into the central channel at an angle of about 15° to 40° to the central axis through a plurality of air holes located in the body at uniform angular distances around the central channel to intertwine the least one multifilament yarn in the central channel; and removing the intertwined yarn at an angle of about 9020 relative to the central axis through the flaring outlet in the body, the yarn being knot-free and having substantially no protruding yarn filament loops.

* * * * *

UNITED STATES PATENT AND TRADEMARK OFFICE

CERTIFICATE OF CORRECTION

PATENT NO. : 5,713,113
DATED : February 3, 1998
INVENTOR(S) : Ali Demir

It is certified that error appears in the above-indentified patent and that said Letters Patent is hereby corrected as shown below:

On the title page, Item [57], in the Abstract, line 6, "17)intersect" should read --17) intersect--.

Claim 15, col. 6, line 51, "9020" should read --90°--.

Signed and Sealed this

Twenty-first Day of April, 1998

Bruce Lehman

*Attest:*

BRUCE LEHMAN

*Attesting Officer*

*Commissioner of Patents and Trademarks*